US011329441B2

(12) United States Patent
Conte et al.

(10) Patent No.: US 11,329,441 B2
(45) Date of Patent: May 10, 2022

(54) METHOD FOR ALIGNING A CRIMPER OF A FIRST TOOL OF A CRIMPING PRESS RELATIVE TO AN ANVIL OF A SECOND TOOL OF THE CRIMPING PRESS

(71) Applicant: Komax Holding AG, Dierikon (CH)

(72) Inventors: Alois Conte, Ebikon (CH); Bruno Weber, Ballwil (CH); Dominik Feubli, Kriens (CH); Stefan Viviroli, Horw (CH)

(73) Assignee: KOMAX HOLDING AG, Dierikon (CH)

( * ) Notice: Subject to any disclaimer, the term of this patent is extended or adjusted under 35 U.S.C. 154(b) by 155 days.

(21) Appl. No.: 16/605,144

(22) PCT Filed: Apr. 25, 2017

(86) PCT No.: PCT/EP2017/059687

§ 371 (c)(1),
(2) Date: Oct. 14, 2019

(87) PCT Pub. No.: WO2018/196950

PCT Pub. Date: Nov. 1, 2018

(65) Prior Publication Data

US 2021/0143603 A1 May 13, 2021

(51) Int. Cl.
*H01R 43/04* (2006.01)
*H01R 43/055* (2006.01)

(52) U.S. Cl.
CPC ..... *H01R 43/055* (2013.01); *Y10T 29/49185* (2015.01)

(58) Field of Classification Search
CPC ..... H01R 43/048; H01R 43/055; H01R 43/0488; Y10T 29/53235; Y10T 29/49181;
(Continued)

(56) References Cited

U.S. PATENT DOCUMENTS 8,555,489 B2 * 10/2013 Malstrom ..... H01R 43/058 29/753
9,548,581 B2 * 1/2017 Nicholas ..... H01R 43/055
(Continued)

FOREIGN PATENT DOCUMENTS

CN 1317855 A 10/2001
CN 202639017 U 1/2013
(Continued)

*Primary Examiner* — Thiem D Phan
(74) *Attorney, Agent, or Firm* — William J. Clemens; Shumaker, Loop & Kendrick, LLP

(57) ABSTRACT

A method for aligning a crimper of a first tool of a crimping press relative to an anvil of a second tool of the crimping press, wherein the crimper and the anvil make a crimp connection jointly by moving the crimper relative to the anvil in a first direction, includes: determining a lateral offset of a center line of the crimper to a center line of the anvil in a second direction perpendicular to the first direction, wherein the center line of the crimper runs through a center of the crimper and in the first direction and wherein the center line of the anvil runs through a center of the anvil and in the first direction; and moving the crimper relative to the anvil in the second direction for lowering the lateral offset.

12 Claims, 5 Drawing Sheets

(58) Field of Classification Search
CPC ..... Y10T 29/53226; Y10T 29/49002; Y10T 29/49185; Y10T 29/49174
USPC ..... 29/863, 720, 748, 751, 753, 854, 857, 29/874
See application file for complete search history.

(56) References Cited

U.S. PATENT DOCUMENTS

| | | | |
|---|---|---|---|
| 2014/0331495 | A1 | 11/2014 | Nicholas et al. |
| 2015/0340827 | A1 | 11/2015 | Hallman et al. |

FOREIGN PATENT DOCUMENTS

| | | | |
|---|---|---|---|
| CN | 103594900 | A | 2/2014 |
| EP | 1381123 | A1 | 1/2004 |
| EP | 1381124 | A1 | 1/2004 |
| EP | 1071173 | B1 | 5/2005 |
| EP | 1764881 | A1 | 3/2007 |
| EP | 1764882 | A1 | 3/2007 |
| EP | 1764884 | A1 | 3/2007 |
| JP | H1167416 | A | 3/1999 |
| JP | 2001035629 | A | 2/2001 |
| JP | 2007311062 | A | 11/2007 |
| JP | 2008177031 | A | 7/2008 |
| JP | 2013254687 | A | 12/2013 |
| WO | 2014023879 | A1 | 2/2014 |

* cited by examiner

METHOD FOR ALIGNING A CRIMPER OF A FIRST TOOL OF A CRIMPING PRESS RELATIVE TO AN ANVIL OF A SECOND TOOL OF THE CRIMPING PRESS

FIELD

The present invention relates to a method for aligning a crimper of a first tool of a crimping press relative to an anvil of a second tool of the crimping press and to a crimping press device.

BACKGROUND

By "crimping" there is understood the production of a non-detachable electrical and mechanical connection (crimp connection) by plastic deformation between a wire and a crimp contact. Typically, crimping devices each having two tools are used to produce crimp connections of this type: an anvil tool (often the lower part of the crimping device), which is employed like an anvil and may be used for the purpose of supporting the crimp contact and an insulation-stripped cable end to be connected to the crimp contact from one side, and a stamp tool (often the upper part of the crimping device), which is used for the purpose of pressing the crimp contact together with the cable end to be connected against the anvil tool and deforming it suitably. The crimp connection between a crimping contact and a wire, for example, insulation-stripped strands or complete conductors of copper or steel, is made by moving a crimper of a first tool relative to an anvil of a second tool of the crimping press. A crimping press device having two tools is known from EP 1 381 123 A1, each of the tools being implemented as a replaceable part and each of the tools being exchangeable independently of the other tool. The crimper, which is part of the first/upper tool, is led in a sliding guide. For crimping, i.e., connecting or joining a cable/wire with a crimp contact, the crimper of the crimping device has to be aligned to the anvil of the crimping device. In particular, the center of the crimper has to be aligned to the anvil. The better the alignment between the crimper and the anvil is, the higher the quality of the crimp connection made by the crimper and the anvil is. In particular relevant for the quality of the crimp connection is the offset between the crimper and the anvil in a second direction in which crimp contacts are fed to the crimping device. When changing one or both of the tools the alignment between the anvil and the crimper has to be redone.

One object of the present invention is to provide a method for aligning a crimper of a first tool of a crimping press relative to an anvil of a second tool of the crimping press which can be executed technically easily, reliably and fast with a high precision and to provide a crimping press device wherein a crimper of the crimping press device can be aligned relative to an anvil of the crimping press device technically easily, reliably and fast.

SUMMARY

In particular, the object is solved by a method for aligning a crimper of a first tool of a crimping press relative to an anvil of a second tool of the crimping press, wherein the crimper and the anvil are adapted for making a crimp connection jointly by moving the crimper relative to the anvil in a first direction, wherein the method comprises the following:—determining a lateral offset of the crimper relative to the anvil, wherein the lateral offset is an offset of a center line of the crimper to a center line of the anvil in a second direction, wherein the second direction is perpendicular to the first direction, wherein the center line of the crimper runs through a center of the crimper and in the first direction and wherein the center line of the anvil runs through a center of the anvil and in the first direction; and—moving the crimper relative to the anvil in the second direction for lowering the lateral offset.

One advantage hereof is that typically the (center of the) crimper can be aligned relative to the (center of the) anvil in a very short time. Thus, usually, after installing and/or changing the crimper/first tool and/or the anvil/second tool, the crimper can be realigned in a very short time relative to the anvil. Also, generally, the alignment is achieved reliably. In addition, normally, the method can be carried out technically easily. Generally, after applying this method, the anvil is at the center of the crimper, and vice versa. Therefore, typically, the crimping press can—after applying the method—produce crimp connections with a very high quality.

Moving the crimper relative to the anvil in this method can comprise moving the anvil physically, moving the crimper physically or moving the anvil as well as the crimper physically. In particular relevant is the relative movement between the crimper and the anvil.

The cited features of the method can but do not have to be carried out as steps one after the other in the given order. Some cited features of the method can be carried out at the same time.

In particular, the object is also solved by a crimping press device comprising—a crimping press with a first tool comprising a crimper and a second tool comprising an anvil, wherein the crimper and the anvil are adapted for making a crimp connection jointly by moving the crimper relative to the anvil in a first direction, and—an aligning device for aligning a center line of the crimper with a center line of the anvil, wherein the center line of the crimper runs through a center of the crimper and in the first direction and wherein the center line of the anvil runs through a center of the anvil and in the first direction, wherein the aligning device is adapted for—determining a lateral offset of the crimper relative to the anvil, wherein the lateral offset is an offset of the center line of the crimper to the center line of the anvil in a second direction, wherein the second direction is perpendicular to the first direction, and—moving the crimper relative to the anvil in the second direction for lowering the lateral offset.

One advantage hereof is that, typically, the (center of the) crimper can be aligned relative to the (center of the) anvil in a very short time. Thus, usually, after installing and/or changing the crimper/first tool and/or the anvil/second tool, the crimper can be realigned in a very short time relative to the anvil. Also, generally, the alignment is achieved reliably. Generally, the anvil can be aligned at the center of the crimper, and vice versa, technically easily. Therefore, typically, the crimping press can produce crimp connections with a very high quality.

Moving the crimper relative to the anvil can comprise moving the anvil physically, moving the crimper physically or moving the anvil as well as the crimper physically. In particular relevant is the relative movement between the crimper and the anvil.

Further features and advantageous effects of embodiments of the invention can among others and without limiting be based on the following ideas and findings.

According to an embodiment, the second direction runs parallel to a direction of a crimp contact feed for feeding crimp contacts to the crimping press. By this, generally, the crimper and the anvil can be aligned relative to the crimp contact feed additionally. Usually, this further improves the crimping quality, i.e., the quality of the crimp connections.

According to an embodiment, the method further comprises the following: —redetermining the lateral offset of the crimper relative to the anvil; and—comparing the redetermined lateral offset with a tolerance range of the lateral offset for determining if the re-determined lateral offset lies within the tolerance range or not. Generally, one advantage hereof is that a feedback signal after moving the crimper relative to the anvil is generated. Thus, usually, the quality of the produced crimp connections after aligning the crimper relative to the anvil can be estimated reliably.

According to an embodiment, the crimper is moved relative to the anvil in the second direction by the determined lateral offset before redetermining the lateral offset of the crimper relative to the anvil, when moving the crimper relative to the anvil in the second direction for lowering the lateral offset. Generally, by this, the movement of the crimper relative to the anvil is separated from the second determination of the lateral offset. Usually, this improves the alignment of the crimper relative to the anvil. Furthermore, since the measurement/redetermination is typically done when the crimper rests relative to the anvil, i.e., the anvil is not moved, the measurement/determination of the lateral offset is more precise. Thus, typically, the lateral offset can be redetermined with a high precision.

According to an embodiment, the method further comprises the following: if it is deter-mined that the redetermined lateral offset does not lie within the tolerance range, moving the crimper relative to the anvil in the second direction by the redetermined lateral offset. By this, the lateral offset is further reduced typically. Thus, generally, the quality of the crimp connections made by the crimper together with the anvil is further increased.

According to an embodiment, the lateral offset is redetermined repeatedly during the moving of the crimper relative to the anvil in the second direction and the movement of the crimper relative to the anvil is stopped as soon as the redetermined lateral offset lies within the tolerance range. This way, usually, the crimper is moved relative to the anvil only as far as absolutely needed to achieve the tolerance range. Thus, typically, the alignment can be carried out in a very short time.

According to an embodiment, the lateral offset of the crimper relative to the anvil is determined via an optical device, in particular via capturing a digital image with a digital camera and analyzing the captured digital image via an analyzing device. By this, typically, the lateral offset is determined very precisely. Furthermore, usually, the measurement/determination of the lateral offset does not influence/change the positions of the anvil and/or crimper. Thus, generally, the measurement/determination does not alter the lateral offset of the crimper relative to the anvil. Typically, this increases the precision of the alignment and, thus, the quality of crimp connections made after the alignment of the crimper relative to the anvil.

According to an embodiment, an optical axis of the optical device comprises an angle of 5°-30°, preferably of 10°-20°, in particular of approximately 15°, to a third direction which is perpendicular to the first direction and perpendicular to the second direction, wherein the optical axis is tilted towards the anvil. Generally, in the horizontal direction, a support for the crimp contact is often disposed behind the anvil. Usually, this position of the support for the crimp contact can under certain circumstances negatively influence the measurement/determination of the lateral offset between the anvil and the crimper. Typically, the tilt of the optical axis of the optical device reduces or remedies this negative influence. Thus, generally, the quality of the crimp connections is further increased.

According to an embodiment, the lateral offset of the crimper relative to the anvil is determined via a measuring probe. Generally, by this, the lateral offset can be determined very precisely. Thus, usually, the lateral offset can be reduced very effectively.

According to an embodiment, the movement of the crimper relative to the anvil is achieved by moving the first tool via a wedge. One advantage hereof is that, typically, the crimper can be moved relative to the anvil very precisely. Thus, in general, the lateral offset can be reduced very effectively.

According to an embodiment, the movement of the crimper relative to the anvil is achieved by moving the second tool via a spindle drive. One advantage hereof is typically that the crimper can be moved relative to the anvil very precisely. Thus, in general, the lateral offset can be reduced very effectively.

According to an embodiment, the movement of the crimper relative to the anvil is achieved by moving only the anvil. This way, typically, the alignment can be carried out in a very short time, since the mass of the anvil is generally very small.

According to an embodiment, the aligning device is further adapted for—redetermining the lateral offset of the crimper relative to the anvil, and—comparing the redetermined lateral offset with a tolerance range of the lateral offset for determining if the redetermined lateral offset lies within the tolerance range or not. Usually, one advantage hereof is that a feedback signal after moving the crimper relative to the anvil can be generated. Thus, in general, the quality of the produced crimp connections after aligning the crimper relative to the anvil can be estimated reliably.

According to an embodiment, the aligning device comprises an optical device for determining the lateral offset, in particular the aligning device comprises a digital camera for capturing a digital image and an analyzing device for analyzing the captured digital image for determining the lateral offset. Typically, by this, the lateral offset can be determined very precisely. Furthermore, in general, the measurement/determination of the lateral offset does not influence/change the position of the anvil and/or crimper. Thus, usually, the measurement/determination does not alter the lateral offset of the crimper relative to the anvil. Typically, this further increases the quality of alignment and, thus, the quality of the crimp connections made by the crimping press.

According to an embodiment, the aligning device is adapted for moving the crimper relative to the anvil in the second direction by the determined offset before redetermining the lateral offset of the crimper relative to the anvil, when moving the crimper relative to the anvil in the second direction for lowering the lateral offset. Typically, by this, the movement of the crimper relative to the anvil is separated from the second measurement of the lateral offset. Furthermore, in general, since the measurement is typically done when the crimper rests relative to the anvil, i.e., the anvil is not moved, the measurement is more precise. Thus, typically, the lateral offset can be redetermined with a high precision.

According to an embodiment, the crimping press device further comprises a movable wedge for moving the crimper. One advantage hereof is that, in general, the crimper can be moved relative to the anvil very precisely. Thus, typically, the lateral offset can be reduced very effectively.

According to an embodiment, the crimping press device further comprises a spindle drive for moving the anvil. The above-mentioned wedge for moving the crimper can be driven by said spindle drive. In general, one advantage hereof is that the crimper can be moved relative to the anvil very precisely. Thus, typically, the lateral offset can be reduced very effectively.

According to an embodiment of the crimping press device, an optical axis of the optical device comprises an angle of 5°-30°, preferably of 10°-20°, in particular of approximately 15°, to a third direction which is perpendicular to the first direction and perpendicular to the second direction, wherein the optical axis is tilted towards the anvil. In the horizontal direction, a support for the crimp contact is often disposed behind the anvil. Typically, this can under certain circumstances negatively influence the measurement/determination of the lateral offset. Generally, the tilt of the optical axis reduces or remedies this negative influence. Thus, typically, the quality of alignment and the quality of the crimp connections produced is increased.

According to an embodiment, the crimping press device further comprises a measuring probe for determining the lateral offset of the crimper relative to the anvil. Typically, by this, the lateral offset can be determined very precisely. Thus, in general, the lateral offset can be reduced very effectively.

It may be noted that possible features and/or benefits of embodiments of the present invention are described herein partly with respect to a method for aligning a crimper of a first tool of a crimping press relative to an anvil of a second tool of the crimping press and partly with respect to a crimping press device. A person skilled in the art will understand that features described for embodiments of a method for aligning a crimper of a first tool of a crimping press relative to an anvil of a second tool of the crimping press may be applied in analogy in an embodiment of a crimping press device according to the invention, and vice versa. Furthermore, one skilled in the art will understand that features of various embodiments may be combined with or replaced by features of other embodiments and/or may be modified in order to come to further embodiments of the invention.

In the following, embodiments of the invention will be described herein with reference to the enclosed drawings. However, neither the drawings nor the description shall be interpreted as limiting the invention.

The figures are only schematic representations and not to scale. Same reference signs indicate same or similar features.

DETAILED DESCRIPTION

Figure 1:
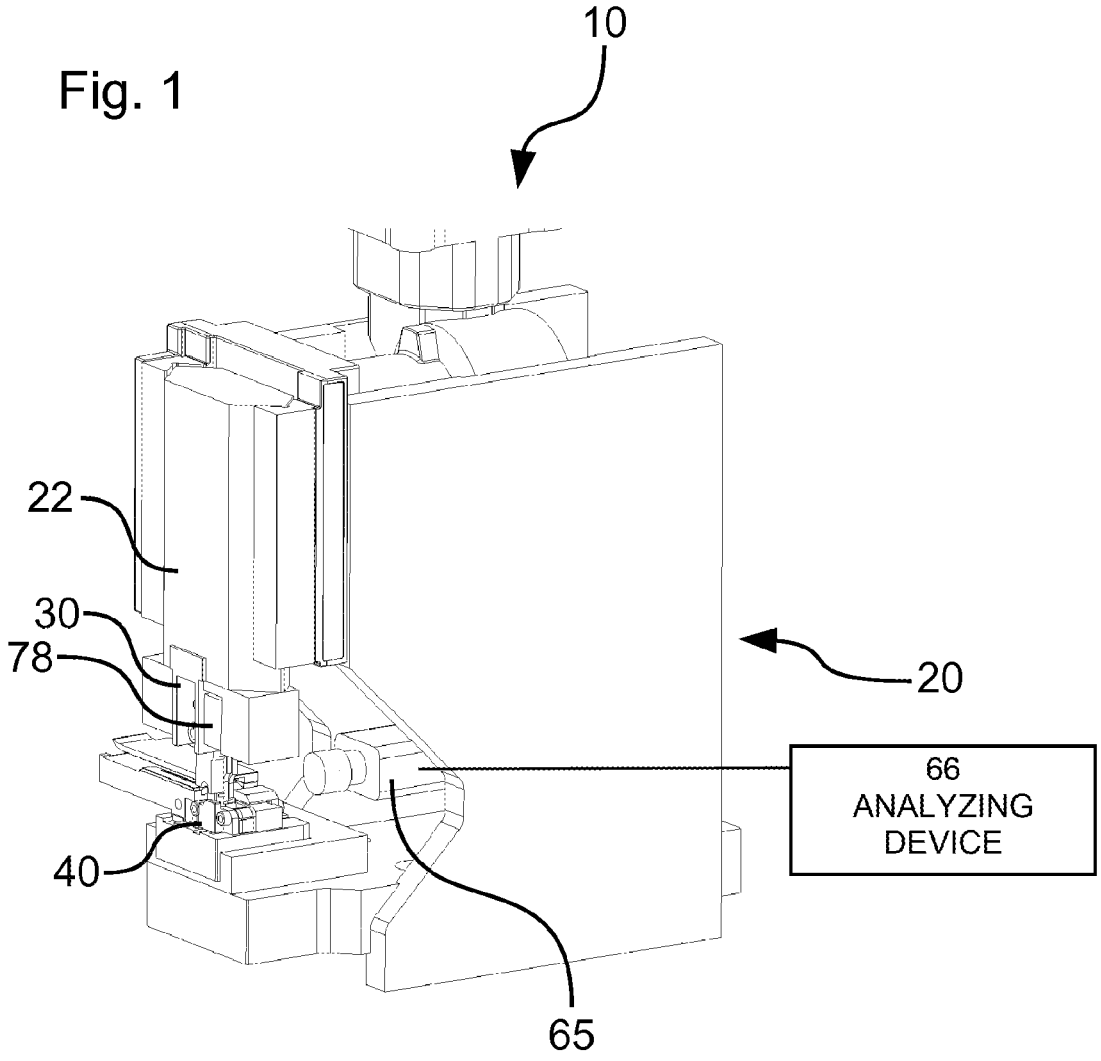
FIG. 1 shows a perspective view of a first embodiment of a crimping press device according to the present invention.
Figure 2:
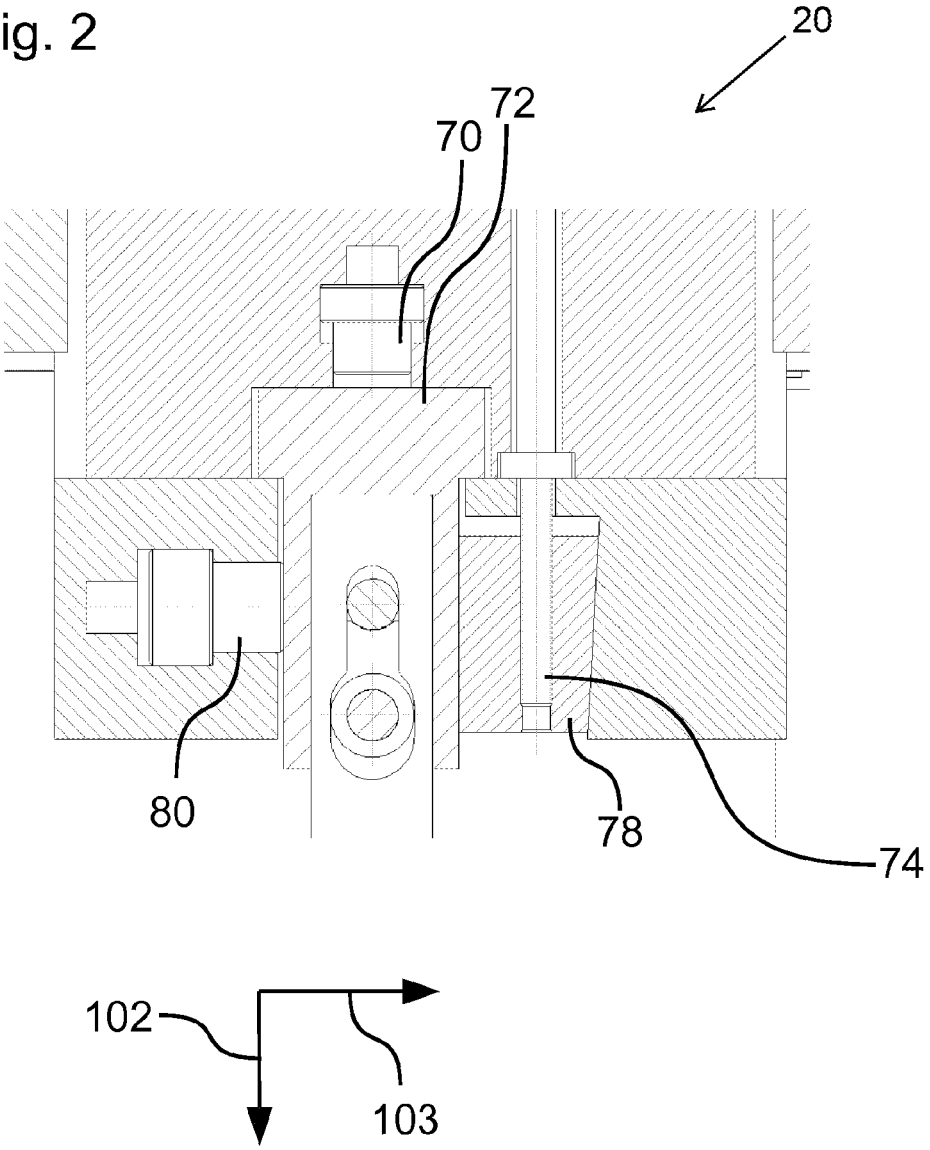
FIG. 2 shows a cross-sectional view of the crimping press device of FIG. 1.
Figure 3:
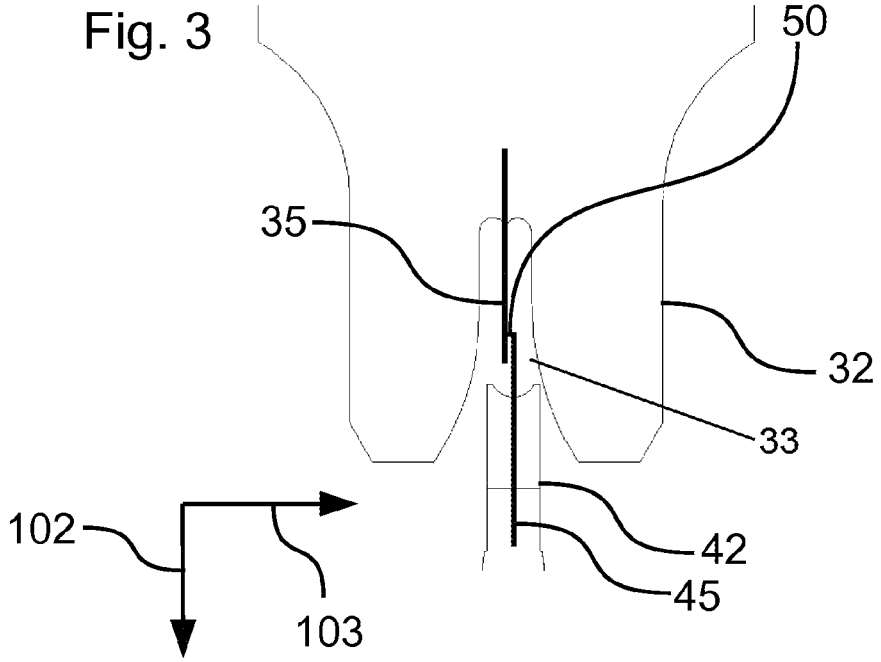
FIG. 3 shows a side view of the crimper and the anvil of the crimping press of FIG. 1 before alignment.
Figure 4:
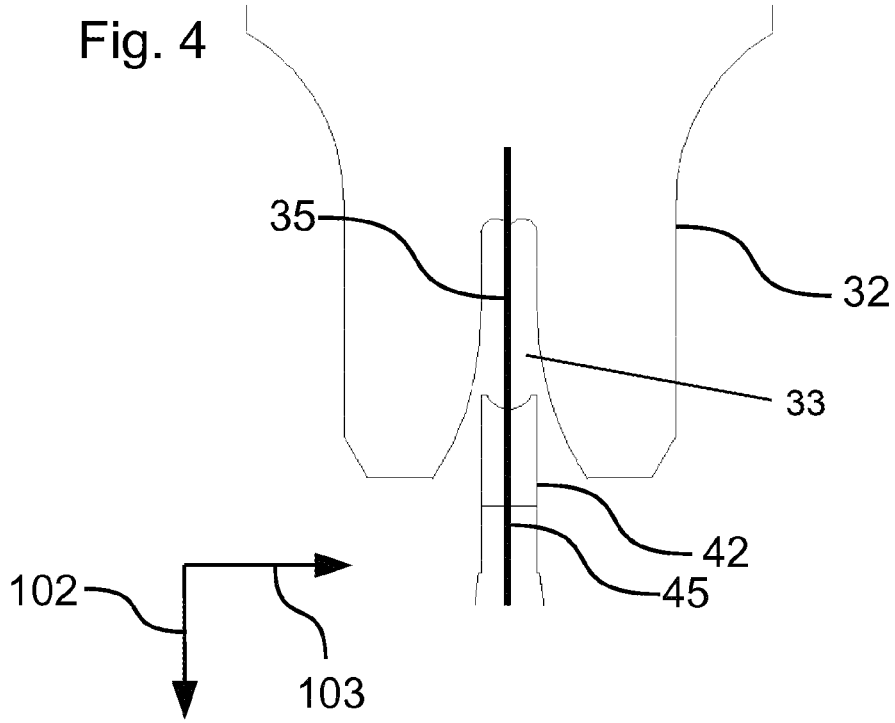
FIG. 4 shows a side view of the crimper and the anvil of the crimping press of FIG. 1 after alignment.

FIG. 1 shows a perspective view of a first embodiment of a crimping press device 10 according to the present invention. FIG. 2 shows a cross-sectional view of the crimping press device 10 of FIG. 1. FIG. 3 shows a side view of the crimper 32 and the anvil 42 of the crimping press device 10 of FIG. 1 before alignment. FIG. 4 shows a side view of the crimper 32 and the anvil 42 of the crimping press device 10 of FIG. 1 after alignment.

The crimping press device 10 comprises a crimping press 20 and an aligning device. The crimping press 20 makes/creates a crimp connection between crimping contacts and a wire/a cable. The crimping contacts are fed via a crimp contact feed 100 from the right or the left in FIG. 2, FIG. 3 and FIG. 4. For a crimp connection with high quality the center of the anvil 42 has to be aligned to the crimper 32 or at the center of the crimper 32. The center of the anvil 42 is at the center line 45 of the anvil 42. The center of the crimper 32 is at the center line 35 of the crimper 32.

The first tool 30 with the crimper 32 is disposed in a press carriage 22 which can be moved up and down. The second tool 40 comprises the anvil 42.

The crimper 32 comprises a cavity 33 in which a part of the anvil 42 is disposed when the crimper 32 and the anvil 42 are in the crimping position.

The crimper 32 which is usually the part/tool which can be moved up or down is moved down into the position at which the crimping connection is made. This direction is also called first direction 102. The first direction 102 runs from the top to the bottom in FIG. 2, FIG. 3 and FIG. 4.

Figure 6:
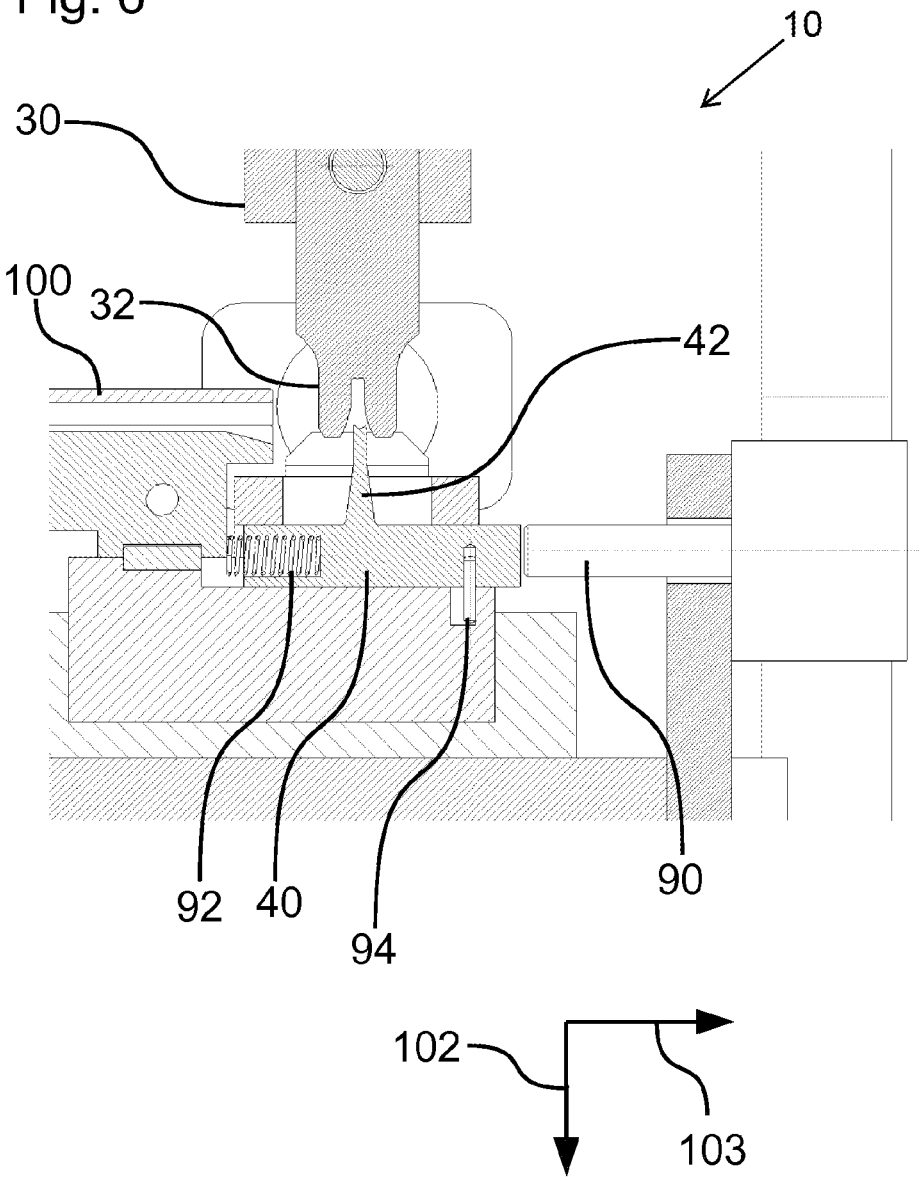
FIG. 6 shows a cross-sectional view of a third embodiment of a crimping press device according to the present invention.

The second direction 103 runs from left to right in FIG. 2, FIG. 3 and FIG. 4 as well as in FIG. 6 (or vice versa). The second direction 103 can be perpendicular to the first direction 102. It is also possible that the second direction 103 is not perpendicular to the first direction 102.

Moving the crimper 32 relative to the anvil 42 can comprise moving the anvil 42 physically, moving the crimper 32 physically or moving the anvil 42 as well as the crimper 32 physically. Relevant is the relative movement between the crimper 32 and the anvil 42.

The lateral offset 50 between the crimper 32 and the anvil 42 is the offset of the center line 45 of the anvil 42 to the center line 35 of the crimper 32 in the second direction 103. The lateral offset 50 corresponds to the shortest distance between the center line 35 of the crimper 32 and the center line 45 of the anvil 42. The center line 35 of the crimper 32 runs through the center of the cavity 33 and in the first direction 102, i.e., in FIG. 3 and FIG. 4 from top to bottom. The center line 45 of the anvil 42 runs through the center of the anvil 42 and in the first direction 102, i.e., in FIG. 3 and FIG. 4 from top to bottom.

The distance of the two center lines 35, 45 to each other in the second direction 103 (which runs from left to right in FIG. 3 and FIG. 4) is the lateral offset 50 between the crimper 32 and the anvil 42.

The aligning device comprises an optical device. The optical device can comprise a digital camera 65 and an analyzing device 66, e.g., a CPU/computer. The optical device captures an image of the crimper 32 and the anvil 42. The image can be taken in a direction which is perpendicular or almost perpendicular to the first direction 102 and perpendicular to the second direction 103. The edges of the crimp jaw, in particular of the crimper 32, and the anvil 42 are captured. The captured image is schematically shown in FIG. 3 and FIG. 4. The digital camera 65 is disposed between the two vertical side plates of the crimping press 20.

The optical axis of the digital camera 65 can be tilted against the horizontal plane. The optical axis of the optical device can comprise an angle of ca. 5°-ca. 30°, preferably of ca. 10°-ca. 20°, in particular of approximately 15°, to a third direction which is perpendicular to the first direction 102 and perpendicular to the second direction 103. The optical axis of the digital camera 65 is tilted towards the anvil 42, i.e., the camera looks (slightly) down in FIG. 1/away from the crimper 32.

The captured image is analyzed and the lateral offset 50 between the center line 35 of the crimper 32 and the center line 45 of the anvil 42 in the second direction 103 is determined. Since only the edges of one side of the crimper 32 and of one side of the anvil 42 are captured by the digital camera 65, the analyzing of the captured image does not take many resources. The CPU/computer 66 can be a low-priced CPU/computer.

When the lateral offset 50 has been determined, the crimper 32 is moved in the second direction 103 such that the lateral offset 50 between the center line 45 of the anvil 42 and the center line 35 of the crimper 32 is reduced. The movement is done from the position shown in FIG. 3 to the position shown in FIG. 4. If a lateral offset 50 as shown in FIG. 3 is present, the anvil 42 is moved to the left or the crimper 32 is moved to the right or both movements are combined.

The first tool 30 comprising the crimper 32 can be moved via a wedge 78. The wedge 78 presses the crimper 32 against a counter bolt 80 in the second direction 103 (in FIG. 2 from right to left). The further the wedge 78 is moved to the bottom in FIG. 2, the further the crimper 32 is moved to the left and pressed against the counter bolt 80. The further the wedge 78 is moved to the top in FIG. 2, the further the crimper 32 is moved to the right in FIG. 2. A clamping bolt 70 presses from the top onto a housing 72 of the first tool 30. The clamping bolt 70 fastens the first tool 30 in the press carriage 22. The press carriage 22 can be moved up and down for moving the first tool 30 with the crimper 32 up and down.

The wedge 78 can be moved via spindle 74. This way, the crimper 32 can be moved very precisely. The wedge 78 is in contact with the housing 72 of the first tool 30 on one side (the left side in FIG. 2) and on the other side (the right side in FIG. 2) with an inclined surface of the crimping press body.

The lateral offset 50 can be redetermined via the optical device. The redetermined lateral offset 50 can be compared to a tolerance region. The tolerance range can be 10 μm. I.e., a lateral offset 50 between the crimper 32 and the anvil 42 of 10 μm or less is acceptable/can be tolerated. The tolerance range can be 5 μm or 1 μm. The redetermined lateral offset 50 is compared with the tolerance range. If the redetermined lateral offset 50 is within/smaller than the tolerance range, a positive outcome of the comparison is given. This positive outcome can be a (digital) electronic signal and/or can be indicated by a green light at the crimping press 20. Crimp contacts then are fed via a crimp contact feed 100 to the crimper 32 and the anvil 42.

If the redetermined lateral offset 50 is larger than the tolerance range (e.g., 12 μm when the tolerance range is 10 μm), a negative outcome of the comparison is given. This negative outcome can be a (digital) electronic signal and/or can be indicated by a red or yellow light at the crimping press 20.

If the redetermined lateral offset 50 is not within the tolerance range, the crimper 32 can be moved again relative to the anvil 42 by the redetermined lateral offset 50. After this second movement, a further redetermination and comparison with the tolerance range can be done to determine if the lateral offset 50 is below/within the tolerance range. The outcome of the new comparison can be a digital electronic and/or can be indicted via a green or yellow/red light at the crimping press 20.

The redetermination of the lateral offset 50 can be done after the crimper 32 has been moved relative to the anvil 42 by the determined lateral offset 50. Alternatively, the lateral offset 50 can be redetermined during the movement of the crimper 32 relative to the anvil 42. The movement can be stopped when the crimper 32 has been moved relative to the anvil 42 by the determined offset in the first case. In the latter case (when redetermining the lateral offset 50 during the movement), the movement of the crimper 32 relative to the anvil 42 is stopped as soon as the redetermined lateral offset 50 lies within the tolerance range. E.g., when the tolerance range is 10 μm, the movement of the crimper 32 relative to the anvil 42 is stopped in the latter case as soon as the lateral offset 50 of the center line 35 of the crimper 32 relative to the center line 45 of the anvil 42 is 10 μm or less.

Alternatively or additionally to the optical device the lateral offset 50 can be determined and/or redetermined via a measuring probe. The measuring probe can be a 3D measuring probe.

All manufacturing tolerances of the crimping press 20, in particular the anvil 42 and the crimper 32 are taken into account by the described aligning method.

Instead of or additionally to the crimper 32, the anvil 42 can be moved physically. By way of example, the movement of the anvil 42 can be achieved via a wedge (not shown here), as previously described in connection with the crimper 32.

For a change of the first tool 30 the clamping bolt 70 and the counter bolt 80 can be retracted (e.g., pneumatically).

Figure 5:
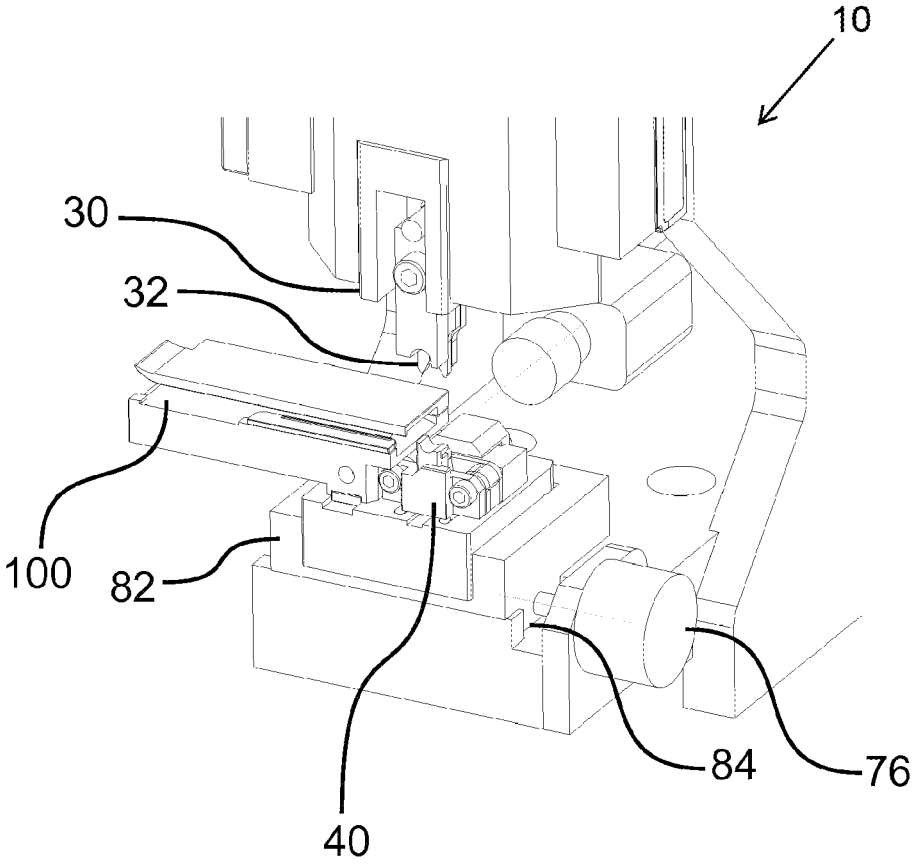
FIG. 5 shows a perspective view of a second embodiment of a crimping press device according to the present invention.

FIG. 5 shows a perspective view of a second embodiment of a crimping press device 10 according to the present invention.

The main difference between the first embodiment and the second embodiment is that while the crimper 32 can be moved in the second direction 103 in the first embodiment, in the second embodiment the anvil 42 can be moved physically in the second direction 103.

The second tool 40 is led in a sliding guide 84/receptacle 82. The second tool 40 is moved as a whole including the anvil 42 via a spindle drive 76.

FIG. 6 shows a cross-sectional view of a third embodiment of a crimping press device 10 according to the present invention. In the third embodiment, only the anvil 42 is moved, i.e., not the second tool 40 as a whole is moved.

The anvil 42 is pressed by a movable end stop 90 against a compression spring 92. The movement of the anvil 42 relative to the second tool 40 is limited by a pin 94 which connects the second tool 40 with the receptacle 82. The movable end stop 90 can be retracted to the right of FIG. 6 so that second tool 40/anvil 42 can be exchanged.

In all three embodiments, the method can be carried out as follows:

First, the upper tool with the crimper 32 is moved in the first direction 102 towards the second tool 40/the anvil 42 so that the optical device 65 captures the anvil 42 and the crimper 32 while making sure no physical/mechanical contact between the anvil 42 and the crimper 32 occurs.

The optical device 65 captures one or several images/videos of the anvil 42 and the crimper 32. An example of such an image is shown in FIG. 3. The analyzing software/hardware analyzes the captured image(s) and/or videos and determines the lateral offset 50 between the center line 45 of the anvil 42 and the center line 35 of the crimper 32 in the second direction 103. Typically, the second direction 103 runs horizontally. The lateral offset 50 determines which distance the crimper 32 has to be moved relative to the anvil 42.

The crimper 32 is moved relative to the anvil 42 (or vice versa) to reduce the lateral offset 50. After moving the crimper 32 relative to the anvil 42 by the determined lateral offset 50 or during the moving of the crimper 32 relative to the anvil 42, the lateral offset 50 is redetermined. This can be done via an optical device. An example of such an image after moving the crimper 32 relative to the anvil 42 is shown in FIG. 4.

If the redetermined lateral offset 50 lies within a tolerance range, the movement of the crimper 32 relative to the anvil 42 is stopped. If the redetermined lateral offset 50 does not lie within the tolerance range, the crimper 32 can be moved again relative to the anvil 42 for reducing/lowering the lateral offset 50. Alternatively, an error signal can be produced and/or displayed.

It is also possible that the lateral offset 50 is redetermined during the movement of the crimper 32 relative to the anvil 42. The movement is stopped as soon as the redetermined lateral offset 50 lies within the tolerance range.

It is so possible that no redetermination and no second movement is carried out.

Furthermore, if the redetermined lateral offset 50 does is not lower/within the tolerance range, the first tool 30/upper tool/crimper 32 can be moved further down in the first direction 102, i.e., closer to the anvil 42, such that the accuracy of the captured image is increased. This can be done after the movement of the crimper 32 relative to the anvil 42 by the determined lateral offset 50 or after a part of this movement.

When the anvil 42 has been aligned relative to the crimper 32 (and vice versa), i.e., the lateral offset 50 lies within the tolerance range, the first tool 30/crimper 32 is moved away from the anvil 42 in the starting position. Then, a crimp contact is fed to the crimper 32. Now, the crimping press 20 is ready for carrying out the crimping process.

Finally, it should be noted that terms such as "comprising" do not exclude other elements or steps and the "a" or "an" does not exclude a plurality. Also, elements described in association with different embodiments may be combined.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for aligning a crimper of a first tool of a crimping press relative to an anvil of a second tool of the crimping press, wherein the crimper and the anvil are adapted for making a crimp connection jointly by moving the crimper relative to the anvil in a first direction, the method comprising the following steps:

determining a lateral offset of the crimper relative to the anvil, wherein the lateral offset is a distance between a center line of the crimper and a center line of the anvil in a second direction, wherein the second direction is perpendicular to the first direction, wherein the center line of the crimper runs through a center of the crimper in the first direction and wherein the center line of the anvil runs through a center of the anvil in the first direction; and moving the crimper relative to the anvil in the second direction for lowering the lateral offset, where moving the crimper relative to the anvil includes moving the second tool with a spindle drive.

2. The method according to claim 1 wherein the second direction runs parallel to a direction of a crimp contact feed for feeding crimp contacts to the crimping press.

3. The method according to claim 1 including the steps of:

redetermining the lateral offset of the crimper relative to the anvil; and comparing the redetermined lateral offset with a tolerance range of the lateral offset for determining if the redetermined lateral offset lies within the tolerance range.

4. The method according to claim 3 including moving the crimper relative to the anvil in the second direction by the determined lateral offset before redetermining the lateral offset of the crimper relative to the anvil.

5. The method according to claim 3 including, if it is determined that the redetermined lateral offset does not lie within the tolerance range, moving the crimper relative to the anvil in the second direction by the redetermined lateral offset.

6. The method according to claim 3 including redetermining the lateral offset repeatedly during the moving of the crimper relative to the anvil in the second direction and stopping the movement of the crimper relative to the anvil when the redetermined lateral offset lies within the tolerance range.

7. The method according to claim 1 including determining the lateral offset of the crimper relative to the anvil via an optical device.

8. The method according to claim 7 wherein the optical device is a digital camera and including capturing a digital image of the lateral offset with the digital camera and analyzing the captured digital image with an analyzing device.

9. The method according to claim 7 wherein an optical axis of the optical device is at an angle to a third direction which is perpendicular to the first direction and perpendicular to the second direction, the angle being in a range of 5° to 30°, and wherein the optical axis is tilted at the angle towards the anvil.

10. The method according to claim 1 including determining the lateral offset of the crimper relative to the anvil with a measuring probe.

11. The method according to claim 1 including moving the crimper relative to the anvil by moving the first tool with a wedge.

12. The method according to claim 1 including moving the crimper relative to the anvil by moving only the anvil.

* * * * *